US006519913B2

(12) United States Patent
Higashizaki et al.

(10) Patent No.: US 6,519,913 B2
(45) Date of Patent: Feb. 18, 2003

(54) SCREW CAPPER

(75) Inventors: Takashi Higashizaki, Ishikawa-Ken (JP); Ryohei Nakamura, Ishikawa-Ken (JP); Hiroaki Kitamoto, Ishikawa-Ken (JP); Takashi Miyazaki, Ishikawa-Ken (JP); Masaru Ishii, Ishikawa-Ken (JP)

(73) Assignee: Shibuya Kogyo Co., Ltd., Kanazawa (JP)

( * ) Notice: Subject to any disclaimer, the term of this patent is extended or adjusted under 35 U.S.C. 154(b) by 0 days.

(21) Appl. No.: 10/036,028

(22) Filed: Oct. 29, 2001

(65) Prior Publication Data

US 2002/0116897 A1 Aug. 29, 2002

(30) Foreign Application Priority Data

Feb. 28, 2001 (JP) ..... 2001-053670

(51) Int. Cl.[7] ..... B65B 7/28; B65B 57/00
(52) U.S. Cl. ..... 53/75; 53/331.5
(58) Field of Search ..... 53/75, 317, 331.5

(56) References Cited

U.S. PATENT DOCUMENTS 4,616,466 A * 10/1986 Tanaka et al. ..... 53/75
5,321,935 A * 6/1994 Spatz et al. ..... 53/75
5,400,564 A * 3/1995 Humphries et al. ..... 53/75
5,417,031 A * 5/1995 Bankuty et al. ..... 53/331.5
5,687,552 A * 11/1997 Barca ..... 53/317
6,105,343 A * 8/2000 Grove et al. ..... 53/331.5

FOREIGN PATENT DOCUMENTS

JP 08-072984 3/1996

* cited by examiner

*Primary Examiner*—John Sipos
(74) *Attorney, Agent, or Firm*—Flynn, Thiel, Boutell & Tanis, P.C.

(57) ABSTRACT

A screw capper includes a capping head which comprises a chuck for holding a cap, a motor for driving the chuck for rotation, a cam mechanism for elevating the chuck, and an air cylinder for imparting a load to the chuck. A load imparted by the air cylinder is controlled by a controller to be zero from the beginning of a screwing and tightening operation until an angle of rotation of the chuck exceeds a specific angle where the load is changed, and is controlled to a higher value upon detection of an angle of rotation of the chuck which exceeds the specific angle in the course of the screwing and tightening operation. The arrangement allows a reliable screwing and tightening to be achieved as compared with the prior art while preventing a damage to threads or the occurrence of a cocked cap.

2 Claims, 4 Drawing Sheets

SCREW CAPPER

FIELD OF THE INVENTION

The invention relates to a screw capper which screws and tightens a cap on a vessel, and in particular, to a screw capper which screws and tightens a cap on a vessel formed of plastics.

DESCRIPTION OF THE PRIOR ART

In a screw capper directed to a vessel formed of plastics such as PET bottle or the like, a difficulty in constraining a readily deformable vessel with a gripper has been recognized, and in order to accommodate for this, a cap is screwed and tightened while applying a load on the vessel through the cap. An engaging pawl is caused to bite into the lower surface of a flange provided on the vessel in order to prevent the vessel from rotating during the screwing and tightening operation.

Specifically, the cap is strongly urged against the vessel when a thread formed on the cap is urged against a thread formed on the vessel. If the relative positions of the beginning turns of the threads on the cap and the vessel were as shown in FIG. 4 such that a thread 4N on the cap and a thread 2N on the vessel are overlaid upon each other only at their distal ends, the both threads have reduced pressure responsive areas where the load is concentrated, giving rise to the likelihood that the cap thread 4N may be broken and its fragments may be dispersed to be contained inside the vessel. If the cap thread were not broken, it may climb up the thread on the vessel to be obliquely mounted thereon in the manner of cocked cap.

To overcome this problem, Japanese Laid-Open Patent Application No. 72,984/1996 discloses a proposal to reduce the load applied to the cap by the provision of the engaging pawl mentioned above in combination with an anti-rotation member, formed of rubber or soft resin, which abuts against the barrel of the vessel during the screwing and tightening operation. However, rubber and/or soft resin are readily abradable and the abrasion of these members has the risk of allowing the vessel to rotate, requiring a frequent replacement of the anti-rotation member. Depending on the configuration of the vessel, the latter may be scarred or crashed.

SUMMARY OF THE INVENTION

In view of the foregoing, there is provided a screw capper including conveying means which conveys a vessel, and a capping head which screws and tightens a cap onto the mouth of a vessel which is being conveyed by the conveying means, the capping head comprising cap holder means, rotating means for rotating the cap holder means, elevating means for elevating the holder means, and load imparting means for imparting a load on the holder means which is directed toward a vessel which is located below the holder means.

In accordance with the present invention, the screw capper further comprises means for detecting an angle through which the holder means has rotated, and a controller for controlling the load imparted by the load imparting means. The controller controls the load imparted by the load imparting means to a low value from the beginning of the screwing and tightening operation until the angle through which the holder means has rotated exceeds a specific angle where the load is changed, and controls the load imparted by the load imparting means to a high value in the course of the screwing and tightening operation upon detecting that the angle of rotation of the holder means detected by the angle detecting means has exceeded the specific angle.

With the described arrangement, before the specific angle is exceeded, the load imparted to the holder means is maintained low to enable the screwing and tightening operation to be carried out while avoiding any damage to the threads and preventing the occurrence of cocked cap. After the specific angle is exceeded, the load imparted to the holder means is increased to prevent the vessel from rotating as the screwing and tightening operation is continued. In this manner, a screwing and tightening operation can be achieved in a reliable manner while preventing the vessel from rotating and while avoiding any damage to the threads and the occurrence of cocked cap which would occur otherwise.

Above and other objects, features and advantages of the invention will become apparent from the following description of an embodiment thereof with reference to the attached drawings.

DETAILED DESCRIPTION OF EMBODIMENT

An embodiment of the invention will now be described with reference to the drawings.

Figure 1:
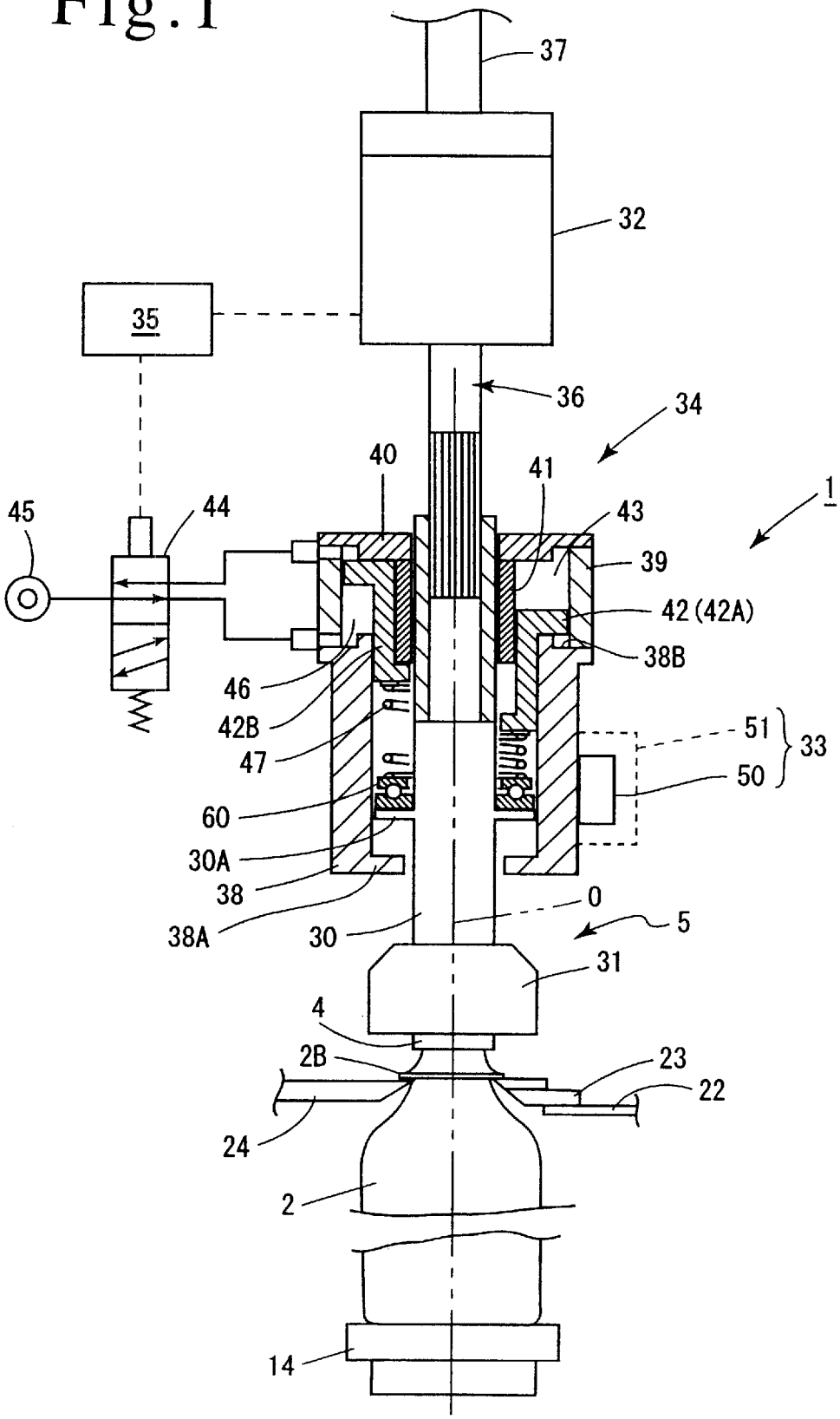
FIG. 1 is a schematic cross section of a rotary screw capper 1 according to the present invention.
Figure 2:
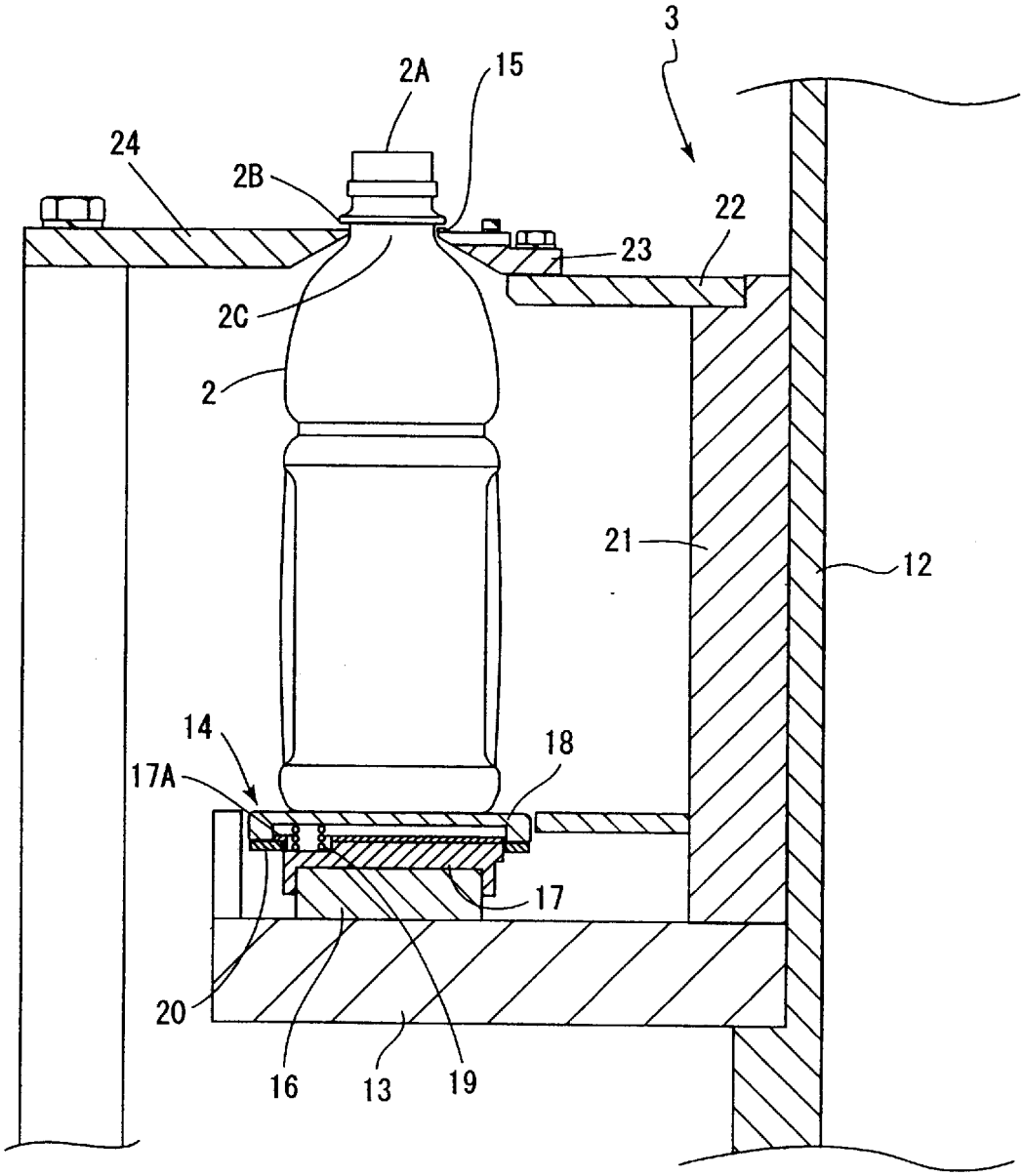
FIG. 2 is a cross section, to an enlarged scale, of a revolving body 3.
Figure 3:
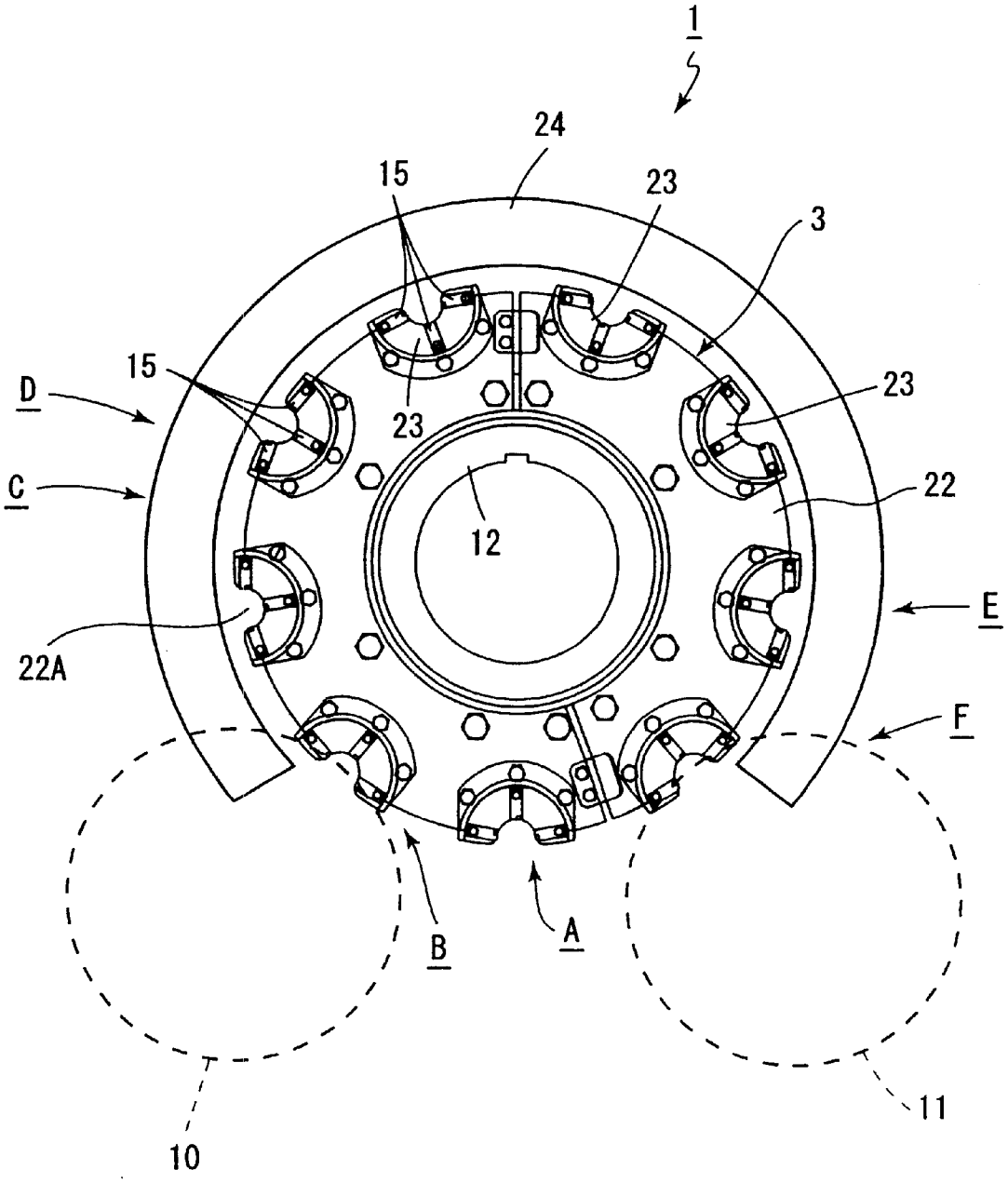
FIG. 3 is a schematic plan view of the revolving body 3.

A rotary screw capper 1 is shown in FIGS. 1, 2 and 3, and comprises a revolving body 3 serving as conveying means which conveys a vessel 2, and a plurality of capping heads 5, each of which functions to screw and tighten a cap 4 onto the mouth 2A of the vessel 2.

The revolving body 3 is arranged to be driven by a drive source, not shown, to rotate clockwise, as viewed in FIG. 3, and a supply starwheel 10 which is disposed at a location adjacent to the revolving body feeds a vessel thereto, and the vessel 2 is discharged from the revolving body by a discharge starwheel 11.

As shown in FIG. 2, the revolving body 3 comprises an upper disc 22 and a lower disc 13 which are mounted on the top and the bottom of a cylindrical member 21 which is integrally connected to a rotating stanchion 12 in the form of a cylinder. At an equal interval around the circumference, the upper disc 22 is formed with arcuate notches 22A, each of which is adapted to receive the neck 2C of the vessel 2. In a corresponding manner, at an equal interval around the circumference, the lower disc 13 is provided with receptacles 14, each serving to place one of the vessels 2 thereon.

An attachment 23 is provided in the region of the arcuate notch 22A in the upper disc 22, and three pawls 15 are disposed at locations corresponding to the opposite ends and a deepest point on the inner peripheral edge of the attachment 23 to serve as engaging members which engage the bottom surface of a flange 2B on the vessel 2 to constrain it against rotation during the screwing and tightening operation.

A guide 24 is disposed around the outer periphery of the upper disc 22 in a region extending from the supply starwheel 10 to the discharge starwheel 11 to surround the neck 2C of the vessel 2 between it and the attachment 23.

The receptacle 14 which is mounted on the lower disc 13 comprises a base 16 in the form of a solid cylinder mounted on the lower disc 13, a circular inner plate 17 mounted on the base 16, a substantially cap-shaped outer plate 18 in which the inner plate 17 is received, and a plurality of springs 19, only one being shown, disposed between the outer plate 18 and the inner plate 17. An engaging portion 17A extends radially outward from the outer periphery of the inner plate 17 to abut against a stop 20 which is provided on the outer plate 18, which normally assumes its upper end position shown where the engaging portion 17A abuts against the stop 20.

Describing the capping head 5, it is disposed above each arcuate notch 22A formed in the upper disc 22 and includes a bracket 37. Specifically, a plurality of brackets 37 are mounted on a disc which is connected to a drive shaft, not shown, at an equal interval around the circumference thereof so that the capping head 5 rotates in an integral manner with the notch 22A in the upper disc 22 and the receptacle 14 on the lower disc 13. The capping head 5 comprises a chuck 31 mounted on the lower end of a spindle 30 and serving as holder means which holds the cap 4, a motor 32 mounted on the bracket 37 and serving as rotating means which causes the chuck 31 to rotate through the spindle 30, a cam mechanism 33 serving as elevating means which causes the chuck 31 to move up and down, an air cylinder 34 serving as load imparting means which imparts a load directed toward the vessel 2 located below the chuck 31 therethrough, and a controller 35 which controls the load imparted by the air cylinder. The controller 35 also controls the motor 32 in addition to the air cylinder 34 in a coordinated manner.

As mentioned previously, the motor 32 is mounted on the bracket 37 and has a drive shaft 36 depending downward, with the free end of the drive shaft being splined into an axial bore in the spindle 30. In this manner, the spindle 30 is driven for rotation by the drive shaft 36 and is also elevatable with respect to the drive shaft.

The motor 32 may comprise a serve motor which is capable of providing a rotating drive in accordance with torque, speed and angle of rotation commands so that it causes the chuck 31 to rotate in accordance with the commands from the controller 35 to allow the cap 4 held by the chuck to be screwed and tightened onto the mouth 2A of the vessel 2. The motor 32 is also provided with an encoder which provides a pulse signal representing an angle of rotation through which the chuck 31 connected to the drive shaft 36 has rotated, thereby allowing the controller 35 to detect the angle of rotation of the chuck 31. In this embodiment the motor 32 comprises servo motor.

A cylindrical member 38 of a greater diameter than the spindle 30 is disposed in surrounding relationship therewith and carries a cam follower 50, which forms the cam mechanism 33, on its outer peripheral surface. The cam follower 50 engages a groove of a cam 51 which is fixedly mounted along the inside of a path, along which the capping head 5 moves, so as to cause an elevating movement of the cylindrical member 38 in accordance with the locus of the cam 51 as the capping head 5 moves.

At its bottom, the cylindrical member 38 is formed with a projection 38A which extends radially inward, while the spindle 30 is formed with an engaging portion 30A projecting radially outward from the outer periphery thereof at a location above the projection 38A. The arrangement is such that under the condition that the projection 38A is engaged with the engaging portion 30A from below so that the spindle 30 is carried by the projection 38A through the engaging portion 30A, the spindle 30 and the chuck 31 mounted on the lower end thereof can be elevated relative to the rotating shaft 36 of the motor 32 in accordance with the elevating motion of the cylindrical member 38.

At its top end, the cylindrical member 38 is formed with a flat surface 38B, and an outer sleeve 39 is fixedly mounted around the outer periphery of the flat surface, with a doughnut-shaped head cover 40 which surrounds the spindle 30 being mounted on the top end of the outer sleeve 39. An inner sleeve 41 is formed around the inner periphery of the head cover 40 and is slidably fitted around the spindle 30, the inner sleeve 41 depending downward to a position where it overlaps a top portion of the cylindrical member 38. The outer sleeve 39, the head cover 40 and the inner sleeve 41 are designed to be elevated in an integral manner with the cylindrical member 38 to define an annular space in which a top portion of a cylindrical piston 42 is received.

At its top end, the piston 42 is formed with a flange 42A, which is vertically slidable while maintaining a hermetic seal between the outer sleeve 39 and the inner sleeve 41. The piston 42 has a cylindrical portion 42B which projects downward through a clearance between the inner periphery of the cylindrical member 38 and the outer periphery of the inner sleeve 41 and is vertically slidable while maintaining a hermetic seal therebetween. This defines the air cylinder 34.

A first pressure chamber 43 is formed above the flange 42A and selectively communicates with a source of compressed air 45 or the atmosphere through a solenoid operated valve 44. A second pressure chamber 46 is defined below the flange 42A and selectively communicates with the source of compressed air 45 or the atmosphere through the solenoid operated valve 44, the solenoid operated valve 44 being switched by the controller 35.

A spring 47 is disposed above the engaging portion 30A which projects from the spindle 30 with a bearing 60 interposed therebetween to avoid the influence of rotation of the spindle 30. As will be described later, when the air cylinder 34 is actuated to cause the piston 42 to compress the spring 47, a load can be imparted to the chuck 31 through the spindle 30. In the present embodiment, the spring 47 is charged to permit a load on the order of 20 kg to be imparted to the vessel.

The operation of the screw capper 1 constructed in the manner mentioned above will now be described.

At a cap supply position A shown in FIG. 3, the cylindrical member 38 of the capping head 5 assumes its raised position under the influence of the cam mechanism 33, and the engaging portion 30A of the spindle 30 also assumes its raised position to which it is raised by the projection 38A. At this time, the second pressure chamber 46 of the air cylinder 34 is fed with compressed air, whereby the piston 42 remains at its raised position to be spaced from the spring 47, and thus has no action of compressing the spring. Under this condition, feeder means, not shown, successively supplies a cap to the chuck 31 while it remains stationary.

At a vessel supply position B which is located downstream of the cap supply station A, the supply starwheel 10 successively supplies the vessel 2 onto the receptacle 14 on the revolving body 3. As soon as the vessel is placed on the receptacle 14, it is held sandwiched between the attachment 23 and guide 24 around the neck 2C thereof to avoid its turn-over while it is being conveyed by the revolving body 3.

Subsequently, as the capping head 5 moves in following relationship with the movement of the vessel 2, the chuck 31 reaches a descent initiating position C, and a down movement of the cylindrical member 38 which is caused by the cam mechanism 33 causes the chuck 31 to move down toward the vessel 2 which is located below it. The spindle 30 and the chuck 31 then stop the downward movement upon abutment of the thread 4N on the cap 4 which is carried by the capping head against the thread 2N on the vessel 2, but the cylindrical member 38 continues its downward movement in accordance with the locus of the cam groove 51 until the projection 38A is removed from the engaging portion 30A of the spindle 30, whereupon it stops its downward movement. At this time, the piston 42 of the air cylinder 34 abuts against the upper end of the spring 47, but does not yet compress it, as indicated on the left-hand side of a centerline O shown in FIG. 1 and accordingly, the vessel is loaded by only the weight of the spindle 30, the spring 47 and the chuck 31 which is applied through the cap 4. Under this condition, the pawls 15 on the attachment 23 abut against the lower surface of the flange 2B, but do not bite into it, and thus is not in engagement therewith.

In the present embodiment, the condition in which the weight of the spindle 30, the spring 47 and the chuck 31 is applied to the vessel located below, (the weight of the spindle 30 and the spring 47 being applied to the chuck 31) or in which no load is imparted by the air cylinder 34 represents a low load which is controlled by the controller. However, it should be understood that any desired load may be applied at this time by adjusting the amount of compressed air supplied to the first pressure chamber 43 and the second pressure chamber 46 of the air cylinder 34.

Upon recognizing that the capping head 5 has reached a screwing and tightening initiating position D under this condition, the controller 35 delivers a rotation command to the motor 34 in a sequential manner, thus allowing each motor 32 to rotate. On the other hand, the controller monitors the angle of rotation of the chuck 31 in terms of pulse signals fed from the motors 32 which have started to rotate.

As the cap 4 is screwed and tightened onto the vessel 2, the friction acting between the cap 4 and the vessel 2 is small and the torque which is required to perform the screwing and tightening operation is well less than the force of friction acting between the vessel 2 inclusive of content thereof and the receptacle 14, and accordingly, the vessel 2 cannot be rotated in response to the screwing and tightening operation. This prevails until the cap 4 rotates through a given angle of rotation (or a given number of turns). Subsequently, as the screwing and tightening operation proceeds and the upper end of the mouth 2A of the vessel 2 begins to abut against the top surface of the cap 4, a torque in excess of the force of friction acting between the vessel 2 and the receptacle 14 is required to continue the screwing and tightening operation, and unless the vessel 2 is constrained, the vessel 2 will rotate as the cap is screwed and tightened onto the vessel, preventing a further screwing and tightening operation. Accordingly, the present invention takes this into consideration by controlling the load imparted to the chuck 31 from the air cylinder 34 to be a low value until a specific angle of rotation is reached from the beginning of the screwing and tightening operation, thereby allowing the chuck 31 to rotate. The low value of the load is chosen such that the pawls 15 mounted on the attachment 13 cannot engage the lower surface of the flange 2B of the vessel 2, but the screwing and tightening operation can proceed without causing a rotation of the vessel 2.

Figure 4:
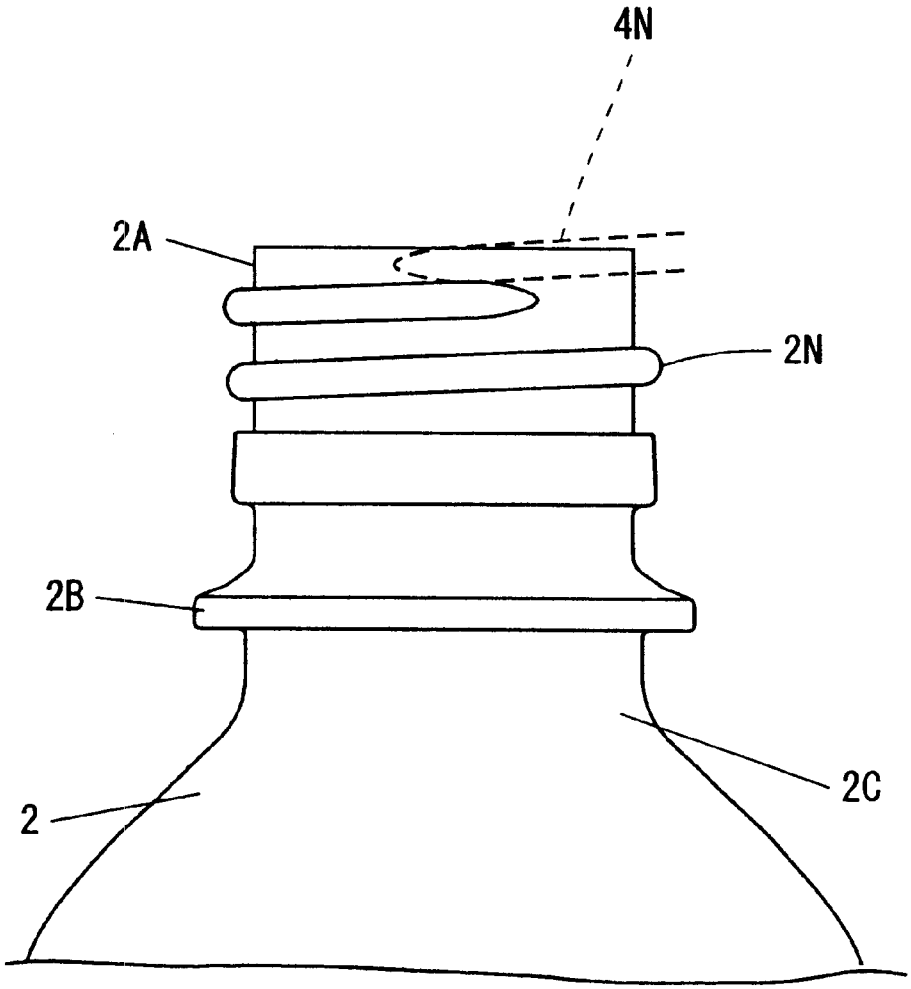
FIG. 4 is a schematic illustration of a thread 4N on a cap 4 and a thread 2N on a vessel 2 which are in meshing engagement with each other.

It will be noted that as the load of a high value is applied from above to the cap 4, it is only when the relative positional relationship prevails that will be produced by a downward movement of the cap 4 to be kept over the mouth 2A of the vessel 2, or more specifically, when the condition shown in FIG. 4 is reached that the thread 4N on the cap 4 and the thread 2N on the vessel 2 are overlapping over their distal ends that a damage to the threads or the occurrence of cocked cap is caused. A damage to the threads or the occurrence of cocked cap can be avoided when the respective threads have increased pressure responsive areas. In consideration of these factors, in the present embodiment, the distal end of the thread 2N on the vessel 2 is chosen as a reference in the rotational direction and an angle of rotation from the reference (which is generally less than 180°) is detected which does not cause a damage to the threads or the cocked cap as the cap 4 is urged under a high load against the vessel 2. This specific angle of rotation is defined as a load changing angle, and the load applied from the air cylinder 34 is controlled to be a low value until the angle of rotation of the chuck 31 from the beginning of the screwing and tightening operation exceeds the specific angle.

Accordingly, if the relative position of the distal end of the thread 2N on the vessel 2 with respect to the distal end of the thread 4N on the cap 4 is moved down over the vessel 2 is such that the distal end of the thread 4N is slightly offset in the screwing and tightening direction beyond the distal end of the thread 2N on the vessel 2 (see FIG. 4), the application of the high load is avoided when the both threads abut against each other, and the low load is maintained until the chuck 31 is further rotated to exceed at least the specific angle, thus avoiding a damage to the threads or the occurrence of a cocked cap. If the distal end of the thread 4N on the cap 4 is offset from the distal end of the thread 2N on the vessel 2 in a direction opposite from the screwing and tightening direction, the distal end of the thread 4N will abut against the thread 2N on the vessel at a location on the next turn which is adjacent to the turn on which the distal end of the thread 2N shown in FIG. 4 is located, where a damage to the threads or the occurrence of the cocked cap is inherently avoided.

Accordingly, in the present embodiment, after the rotation of the chuck 31 has been started, an angle of rotation thereof which exceeds the specific angle is detected, and the controller 35 switches the solenoid operated valve 44 to open the second pressure chamber 46 to the atmosphere while introducing the compressed air into the first pressure chamber 43, thus driving the piston 42 down to compress the spring 47, thus controlling the load which is imparted to the chuck 31 to a high value (see the illustration on the right-hand side of the centerline O in FIG. 1). In this manner, the high load on the order of 20 kg is directed toward the vessel 2 through the cap 4, whereupon the pawls 15 on the attachment 23 bite into or engage with the lower surface of the flange 2B of the vessel 2, thus preventing the vessel 2 from being rotated in response to the continued screwing and tightening operation. When the screwing and tightening operation is continued under this condition, a rotation of the vessel 2 can be prevented even after the upper end of the mouth 2A of the vessel 2 abuts against the top surface of the cap 4, which is then deformed to allow a further screwing and tightening of the cap 4.

When it is detected that an angle of rotation from beginning of rotation of the motor 32 has reached a given value, the controller 35 ceases the motor 32 to operate, thus completing the screwing and tightening operation. By the time the capping head 5 reaches an ascent initiating position E, the controller 35 releases the cap 4 from the chuck 31 and also switches the solenoid operated valve 44 to open the first pressure chamber 43 to the atmosphere while introducing the compressed air into the second pressure chamber 46 to drive the piston 42 upward, thus terminating the compression of the spring 47. During the time the capping head 5 moves from the ascent initiating position E to a discharge position F, it is raised by the action of the cam mechanism 33, and accordingly, the vessel 2 having the cap 4 screwed and tightened thereon is externally discharged by the discharge starwheel 11.

In the above description of the embodiment, the angle of rotation of the chuck 31 is determined on the basis of the pulse signal from the encoder which is provided on the motor 32. However, the controller 35 may include a timer which measures the length of time during which the motor 32 rotates at a given speed from the beginning of its rotation, thereby detecting the angle of rotation of the chuck 31 and thus detecting that the angle of rotation thereof has exceeded the specific angle.

It will be noted that in the present embodiment, the specific angle where the load is changed is determined as an angle of rotation, (which is generally less than 180°) where a required pressure responsive area is obtained. However, the choice of the specific angle is not limited to such value. Alternatively, there is no problem whatsoever for practical purpose if the load imparted to the chuck 31 is set to a low value until the vessel 2 begins to rotate during the screwing and tightening operation or until the top end of the mouth 2A of the vessel 2 abuts against the top surface of the cap 4. The specific angle where the load is changed may be chosen somewhere in such region.

In this instance, means for detecting the abutment of the top end of the mouth 2A against the top surface of the cap 4 may utilize the detection of a current or a voltage value supplied to the motor 32 to determine the torque applied to the chuck 31. Specifically, the abutment can be detected by detecting a rapid increase in the torque applied to exceed a given threshold value. It will be understood that the amount by which the cap 4 is screwed and tightened onto the vessel 2 when the top end of the mouth 2A abuts against the top surface of the cap 4 or the angle of rotation of the thread 4N on the cap 4 as referenced to the distal end of the thread 2N on the vessel 2 remains constant, and accordingly, the elevation of the cap 4 as referenced to the receptacle 14, for example, also remains constant. Thus, by providing means which detects the elevation of the chuck 31, a descent of the chuck 31 to a given elevation can be detected and the abutment can be detected in this manner.

It will be understood from the foregoing description that the choice of a low value of the load imparted to the chuck 31 before the specific angle is exceeded allows the screwing and tightening operation to be performed while preventing a damage to the threads or the occurrence of the cocked cap if the thread 4N on the cap 4 and the thread 2N on the vessel 2 overlap each other only over their distal ends at the beginning of the screwing and tightening operation. The load imparted to the chuck 31 is increased after the specific angle is exceeded, thus allowing the screwing and tightening operation to be continued in a reliable manner while preventing the vessel 2 from rotating as the screwing and tightening operation proceeds.

In the described embodiment, the air cylinder 34 has been used as means for imparting a load. However, such means is not limited to the air cylinder, but alternatively, the cam mechanism may be utilized to compress the spring 47 or the spring 47 may be replaced by the repulsion effect of a magnet clutch.

While the invention has been mentioned above in connection with a preferred embodiment thereof, it should be understood that a number of changes, modifications and substitutions therein are possible from the above disclosure without departing from the spirit and scope of the present invention as defined by the appended claims.

What is claimed is:

1. A screw capper including conveying means for conveying a vessel, and a capping head for screwing and tightening a cap onto the mouth of a vessel being conveyed by the conveying means, the capping head comprising holder means for holding a cap, means for rotating the holder means, elevating means for elevating the holder means, and load imparting means for imparting a load which is directed toward the vessel located below the holder means; the screw capper further comprising means for detecting an angle of rotation of the holder means, and a controller for controlling a load imparted by said load imparting means, the controller being operative from the beginning of a screwing and tightening operation until the angle of rotation of a holder means exceeds a specific angle where a load is changed to control the load imparted by the load imparting means to a low value and operative upon detection of an angle of rotation of the holder means which exceeds the specific angle to control the load imparted by the load imparting means to a high value.

2. A screw capper according to claim 1 in which the conveying means includes an engaging member which engages the lower surface of a flange provided on the vessel when the load is imparted to the vessel by the load imparting means.

* * * * *